US006345795B1

(12) United States Patent
Bartz, Jr.

(10) Patent No.: US 6,345,795 B1
(45) Date of Patent: Feb. 12, 2002

(54) SHELF BRACKET

(75) Inventor: William L. Bartz, Jr., Dover, DE (US)

(73) Assignee: Metal Masters Foodservice Equipment Co., Inc., Clayton, DE (US)

( * ) Notice: Subject to any disclaimer, the term of this patent is extended or adjusted under 35 U.S.C. 154(b) by 0 days.

(21) Appl. No.: 09/511,832

(22) Filed: Feb. 24, 2000

(51) Int. Cl.[7] ..... A47G 29/02; E04G 3/08; E06B 7/28

(52) U.S. Cl. ..... 248/247; 248/241; 248/243; 211/150; 211/187

(58) Field of Search ..... 248/247, 235, 248/240.1, 241, 243, 250; 211/187, 149, 150, 153

(56) References Cited

U.S. PATENT DOCUMENTS 4,620,489 A * 11/1986 Albano ..... 108/105
4,934,642 A * 6/1990 Baron et al. ..... 248/250
5,390,803 A 2/1995 McAllister
5,456,435 A * 10/1995 Sweeney ..... 248/250
5,580,018 A * 12/1996 Remmers ..... 248/235
5,592,886 A * 1/1997 Williams et al. ..... 108/108
5,611,442 A 3/1997 Howard
5,695,080 A * 12/1997 Martin ..... 211/183
5,695,163 A * 12/1997 Tayar ..... 248/243
5,797,503 A * 8/1998 Stevens et al. ..... 211/187
5,921,412 A 7/1999 Merl
5,970,887 A * 10/1999 Hardy ..... 108/108
6,024,333 A * 2/2000 Raasch et al. ..... 248/247
6,105,794 A * 8/2000 Bauer ..... 211/94.01
6,113,042 A * 9/2000 Welsch et al. ..... 248/218.4

* cited by examiner

*Primary Examiner*—Ramon O. Ramirez
*Assistant Examiner*—A. Joseph Wujciak
(74) *Attorney, Agent, or Firm*—Connolly Bove Lodge & Hutz LLP

(57) ABSTRACT

A shelf bracket for supporting and adjustably attaching shelving to vertically support structure comprises an elongate member having opposite end portions, and an open U-shaped shelf supporting channel along a lower edge thereof. One of the end portions of the elongate member includes structure arranged to adjustably attach the bracket to vertical support structure. An inverted U-shaped shelf retaining channel extends along an upper edge of the elongate member. The open U-shaped shelf supporting channel functions to receive and support shelving when inserted therein, and the inverted U-shaped shelf retaining channel functions to snap fit over and thereby retain such shelving.

9 Claims, 2 Drawing Sheets

SHELF BRACKET

BACKGROUND OF THE INVENTION

The present invention relates to a shelf bracket, and more particularly to a bracket for supporting and adjustably attaching wire shelving to a shelving unit such as a gondola shelving unit.

Gondola shelving units are known in the art. These units fundamentally include a lower base with rollers on the undersurface of the base for easy transport of the unit. An upstanding rear wall provides a support surface to which shelving is attached. Outwardly extending shelf brackets are adjustably attached to the rear wall of the gondola, and wire shelving is attached to the brackets.

Many bracket constructions have been proposed over the years but these constructions often fail to easily and effectively support and stabilize the individual shelves relative to the gondola shelving unit.

SUMMARY OF THE INVENTION

Accordingly, one of the objects of the present invention is a shelf bracket that supports and stabilizes individual shelves relative to the vertical support surface of a gondola shelving unit.

Another object of the present invention is a shelf bracket which is easy to use and which functions to support shelving in a superior manner.

Still another object of the present invention is a shelf bracket which is easy to manufacture and which function to support and stabilize wire shelving.

In accordance with the present invention, a shelf bracket is provided for supporting an adjustably attaching shelving to vertical support structure. The shelf bracket comprises an elongate member having opposite end portions and an open U-shaped shelf supporting channel along a lower edge thereof. One of the end portions of the elongate member includes structure arranged to adjustably attach the bracket to the vertical support structure. An inverted U-shaped shelf retaining channel extends along an upper edge of the elongate member. In operation, the open U-shaped shelf supporting channel functions to receive and support shelving when a side thereof is inserted in the channel. The inverted U-shaped shelf retaining channel functions to snap fit over and thereby retain the shelving inserted into the lower U-shaped channel.

Preferably, the open U-shaped shelf supporting channel extends between the opposite end portions of the elongate member. The inverted U-shaped channel also extends between the opposite end portions of the elongate member.

The inverted U-shaped shelf retaining channel along the upper edge of the elongate member preferably includes spaced apart notched portions along the length thereof constructed and arranged to fit over horizontal stringers on the shelving connected to the bracket. The interaction between these notched portions and the horizontal stringers operates to positively lock the shelving to the bracket and thereby prevent inadvertent movement of the shelving away from the bracket.

The shelf bracket of the present invention is utilized with wire shelving that includes upper and lower spaced apart wire rods on the opposite sides thereof. The lower rod on each side of the shelving rests within and is supported by the open U-shaped shelf supporting channel while the upper inverted U-shaped shelf retaining channel snap fits over the upper rod to thereby hold the shelving in place on the shelf bracket. The spaced apart notched portions on the inverted U-shaped shelf retaining channel fit over the horizontal stringers on the shelving to thereby lock the shelving to the shelf bracket.

BRIEF DESCRIPTION OF THE DRAWINGS

Novel features and advantages of the present invention in addition to those mentioned above will become apparent to persons of ordinary skill in the art from a reading of the following detailed description in conjunction with the accompanying drawings wherein similar reference characters refer to similar parts and in which.

DETAILED DESCRIPTION OF THE INVENTION

Figure 1:
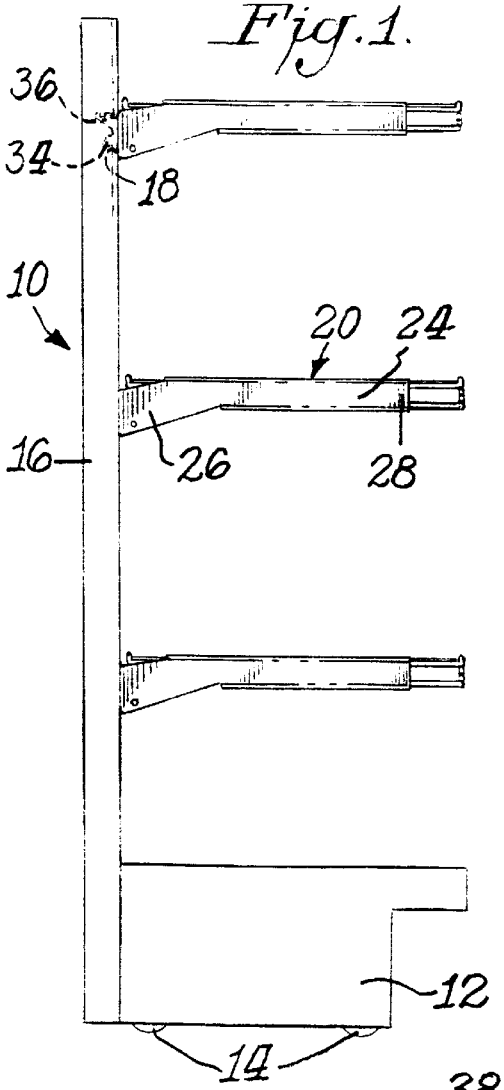
FIG. 1 is a left side elevational view of a gondola shelving unit with wire shelving and shelf brackets, according to the present invention.
Figure 2:
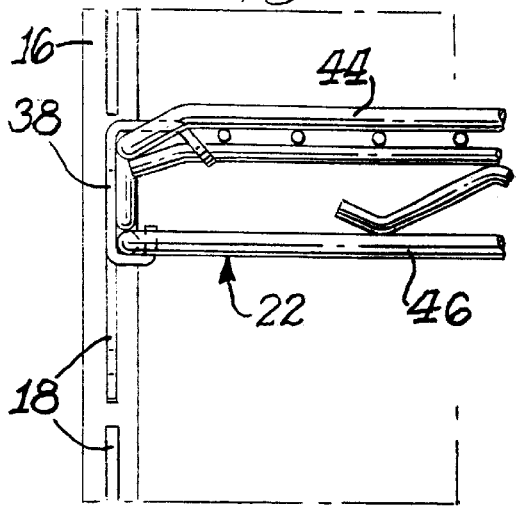
FIG. 2 is a fragmental front elevational view of the left portion of a gondola shelving unit with wire shelving and a left side shelf bracket, according to the present invention.
Figure 3:
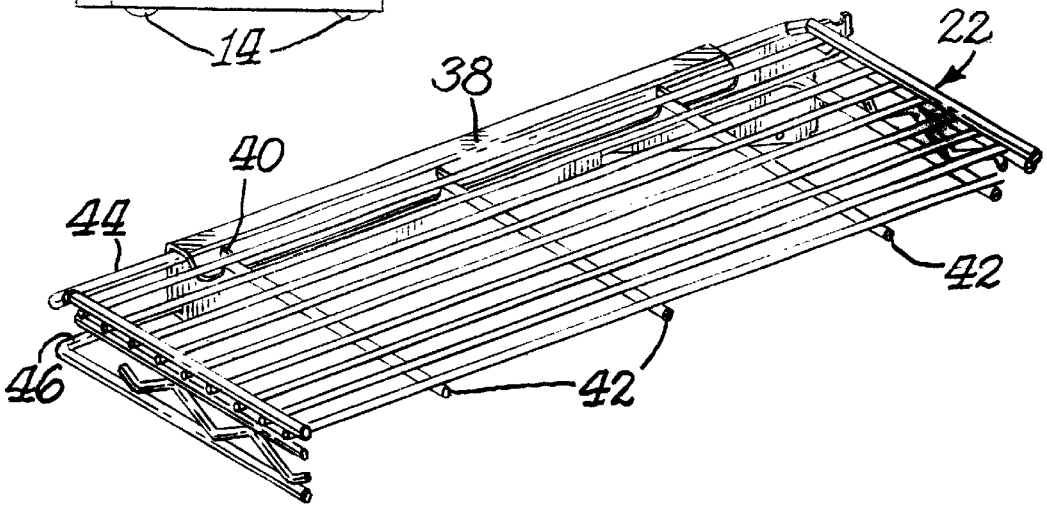
FIG. 3 is a fragmental perspective view of wire shelving and a left side shelf bracket, according to the present invention.
Figure 4:
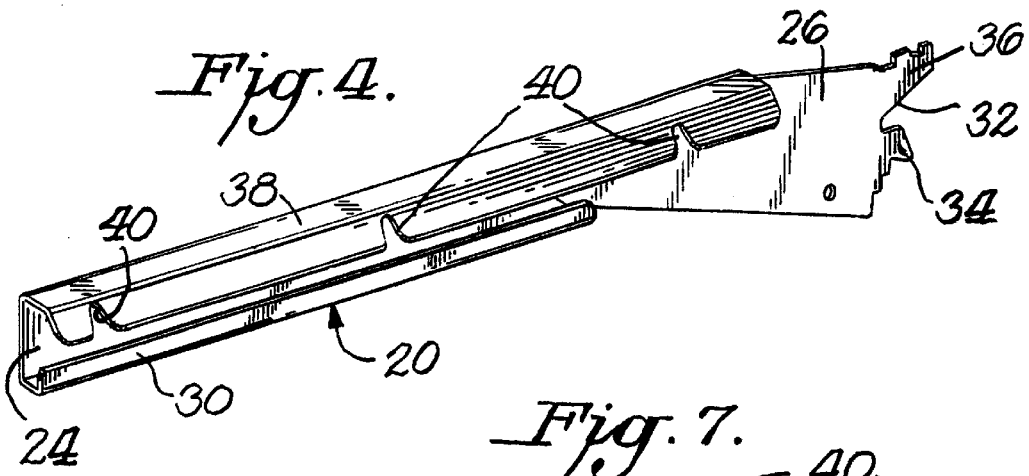
FIG. 4 is a perspective view of a left side shelf bracket, according to the present invention.
Figure 7:
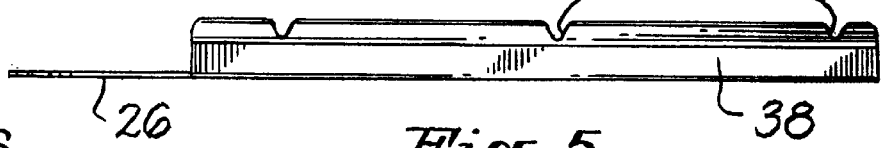
FIG. 7 is a top plan view of the left side shelf bracket shown in FIGS. 4–6.
Figure 6:
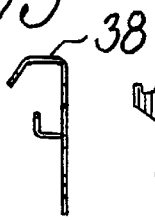
FIG. 6 is a rear elevational view of the left side shelf bracket shown in FIGS. 4 and 5.
Figure 5:
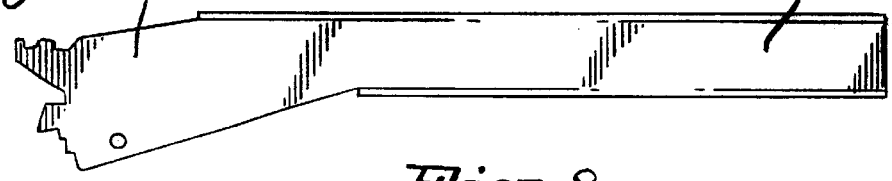
FIG. 5 is a left side elevational view of the left side shelf bracket shown in FIG. 4.
Figure 8:
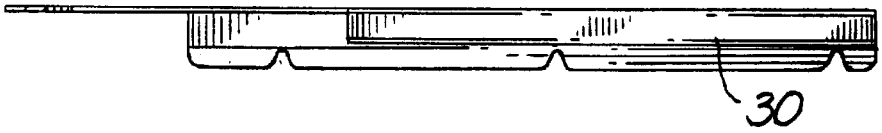
FIG. 8 is a bottom plan view of the left side shelf bracket shown in FIGS. 4–7.
Figure 10:
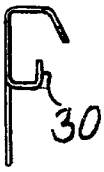
FIG. 10 is a front elevational view of the left side shelf bracket shown in FIGS. 4–9.
Figure 9:
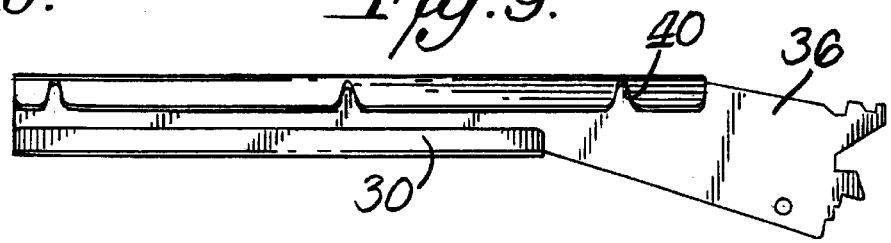
FIG. 9 is a right side elevational view of the left side shelf bracket shown in FIGS. 4–8.

Referring in more particularity to the drawings, FIG. 1 shows a gondola shelving unit 10 comprising a lower base 12 with rollers 14. The gondola shelving unit also includes vertical support structure 16 secured to the lower base 12. As shown best in FIGS. 1 and 2, the vertical support structure includes vertical lines of spaced apart slotted openings 18 for securing the shelf brackets to the vertical support structure.

FIGS. 4 through 9 illustrate a shelf bracket 20 according to the present invention. As explained more fully below, shelf bracket 20 functions to support and adjustably attach shelving 22 to the vertical support structure 16 of the gondola shelving unit 10. Shelf bracket 20 comprises an elongate member 24 having opposite end portions 26, 28, and an open U-shaped shelf supporting channel 30 along a lower edge of the elongate member.

End portion 26 of elongate member 24 includes connecting structure 32 arranged to adjustably attach the shelf bracket to the vertical support structure 16 of the gondola shelving unit 10. Specifically, the connecting structure 32 includes a hook 34 and cut-outs 36 that cooperate with the slotted openings 18 in the vertical support structure 16 of the gondola shelving unit 10. Hook 34 fits within a selected slotted opening 18 and rests against the lower edge of such opening while one of the cut-outs 36 fits within a slotted opening and is held in place against the upper edge of the opening. This particular locking structure is well known and is not a specific part of the present invention.

Each shelf bracket 20 includes an inverted U-shaped shelf retaining channel 38 along the upper edge of the elongate member 24. The inverted U-shaped shelf retaining channel functions to snap fit over shelving 22 when connected to the shelf bracket 20 to thereby retain the shelving in place, as explained more fully below.

Both the open U-shaped shelf supporting channel 30 and the inverted U-shaped shelf retaining channel 38 generally extend between the opposite end portions 26, 28 of the elongate member 24. Additionally, the inverted U-shaped shelf retaining channel 38 includes a plurality of spaced apart notched portions 40 along at the length thereof constructed and arranged to fit over horizontal stringers 42 on the wire shelving 22. The interaction between the notched portions 40 and shelving stringers 42 operates to positively lock shelf bracket 20 to the wire shelving 22.

The wire shelving 22 is similar in many respects to the shelving disclosed in U.S. Pat. No. 5,390,803, granted Feb. 21, 1995, and the subject matter of this patent is incorporated herein by reference. In addition to the horizontal stringers 42, wire shelving 22 includes upper and lower rods 44, 46 at the opposite sides of the shelving. Lower rod 46 is received within and supported by the open U-shaped shelf supporting channel 30 while the inverted U-shaped shelf retaining channel 38 fits over the upper rod 44 of the wire shelving 22.

Shelf bracket 20 is fabricated from sheet metal having some flexibility which enables the inverted U-shaped shelf retaining channel 38 to snap over the upper rod 44 at the side of the wire shelving. The notched portions 40 fit over the horizontal stringers 42 to interlock the shelf bracket 20 and shelving 22 and thereby prevent the shelving from sliding outwardly away from the bracket.

What is claimed is:

1. A shelf bracket for supporting and adjustably attaching shelving to vertical support structure, the shelf bracket comprising an elongate member having opposite end portions and an open U-shaped shelf supporting channel along a lower edge thereof, one of the end portions including structure constructed and arranged to adjustably attach the bracket to the vertical support structure and the other end portion comprising a free end, and an inverted U-shaped shelf retaining channel along an upper edge of the elongate member whereby the open U-shaped shelf supporting channel functions to support shelving when inserted into the channel and the inverted U-shaped shelf retaining channel functions to fit over and thereby retain such shelving to the bracket.

2. A shelf bracket as in claim 1 wherein the open U-shaped shelf supporting channel extends between the opposite end portions of the elongate member.

3. A shelf bracket as in claim 1 wherein the inverted U-shaped shelf retaining channel extends between the opposite end portions of the elongate member.

4. A shelf bracket as in claim 1 wherein the inverted U-shaped shelf retaining channel includes spaced apart notched portions along the length thereof constructed and arranged to fit over horizontal stringers on shelving connected to the bracket.

5. A shelf bracket as in claim 1 in combination with shelving releasably connected to the bracket.

6. A shelf bracket and shelving as in claim 5 wherein the shelving has upper and lower spaced apart rods at opposite sides thereof, and wherein the lower rod of the shelving rests within the open U-shaped shelf supporting channel and the upper rod fits under the inverted U-shaped shelf retaining channel.

7. A shelf bracket and shelving as in claim 6 wherein the shelving includes spaced apart horizontal stringers and the inverted U-shaped shelf retaining channel includes spaced apart notched portions along the length thereof which fit over the horizontal stringers on the shelving.

8. A shelf bracket as in claim 1 wherein the end portion constructed and arranged to adjustably attach the bracket to the vertical support structure includes a hook and cut-outs for releaseable engagement with the vertical support structure.

9. A shelf bracket as in claim 8 in combination with the vertical support structure having slotted openings therein constructed and arranged to receive the hook and cut-outs of the elongate member.

* * * * *

UNITED STATES PATENT AND TRADEMARK OFFICE

CERTIFICATE OF CORRECTION

PATENT NO. : 6,345,795 B1
DATED : February 12, 2002
INVENTOR(S) : William L. Bartz, Jr.

It is certified that error appears in the above-identified patent and that said Letters Patent is hereby corrected as shown below:

Column 3,
Line 39, insert -- a -- before "vertical".

Signed and Sealed this

Twenty-eighth Day of May, 2002

*Attest:*

*Attesting Officer*

JAMES E. ROGAN
*Director of the United States Patent and Trademark Office*